US012808276B2

(12) United States Patent
Hitt et al.

(10) Patent No.: US 12,808,276 B2
(45) Date of Patent: Nov. 24, 2026

(54) TOOL AND METHOD FOR SAFE CAVITY SHOT OPERATIONS

(71) Applicant: Hunting Titan, Inc., Pampa, TX (US)

(72) Inventors: Joseph Hitt, Thornton, CO (US); Adam Dyess, Houston, TX (US); Dale Langford, Pampa, TX (US); Kevin Morton, Mansfield, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 18/843,781

(22) PCT Filed: Jul. 12, 2023

(86) PCT No.: PCT/US2023/070064
§ 371 (c)(1),
(2) Date: Sep. 4, 2024

(87) PCT Pub. No.: WO2024/015866
PCT Pub. Date: Jan. 18, 2024

(65) Prior Publication Data

US 2025/0188827 A1 Jun. 12, 2025

Related U.S. Application Data

(60) Provisional application No. 63/368,205, filed on Jul. 12, 2022.

(51) Int. Cl.

| | |
|---|---|
| ***E21B 33/10*** | (2006.01) |
| ***E21B 43/1185*** | (2006.01) |
| ***E21B 43/263*** | (2006.01) |

(52) U.S. Cl.
CPC ..... *E21B 33/10* (2013.01); *E21B 43/1185* (2013.01); *E21B 43/263* (2013.01)

(58) Field of Classification Search
CPC ..... E21B 43/263; E21B 33/13; E21B 33/10; E21B 43/1185
See application file for complete search history.

(56) References Cited

U.S. PATENT DOCUMENTS

| | | | | |
|---|---|---|---|---|
| 5,525,010 | A * | 6/1996 | Kenny | E21B 29/02 405/195.1 |
| 2006/0196665 | A1 | 9/2006 | LaGrange et al. | |
| 2006/0237190 | A1 | 10/2006 | Snider et al. | |
| 2007/0125540 | A1* | 6/2007 | Gerez | F42D 1/045 166/55 |
| 2008/0099204 | A1 | 5/2008 | Arrell et al. | |
| 2014/0060839 | A1* | 3/2014 | Wang | E21B 43/117 166/299 |

(Continued)

OTHER PUBLICATIONS

Notification of Transmittal Of The International Search Report And The Written Opinion Of The International Searching Authority, Or The Declaration, Oct. 24, 2023, 9 pages.

*Primary Examiner* — Robert E Fuller
(74) *Attorney, Agent, or Firm* — Troutman Pepper Locke LLP; Gabrielle L. Gelozin

(57) ABSTRACT

A method and apparatus for providing a cavity shot tool into a wellbore in a plug and abandonment application, containing liquid propellant within propellant bags, initiated by an RF-Safe modular initiator, igniting the liquid propellant above a casing plug to collapse the casing, wellbore and/or formation onto itself, to create a natural barrier that is then sealed with cement.

14 Claims, 1 Drawing Sheet

(56) References Cited

U.S. PATENT DOCUMENTS

| | | | | |
|---|---|---|---|---|
| 2015/0107090 | A1 | 4/2015 | Keppler et al. | |
| 2015/0330192 | A1* | 11/2015 | Rogman | E21B 43/1185 166/297 |
| 2016/0010414 | A1* | 1/2016 | Bell | E21B 29/02 166/55 |
| 2018/0087363 | A1* | 3/2018 | Willberg | E21B 43/263 |
| 2018/0202277 | A1 | 7/2018 | Sawka et al. | |
| 2019/0353014 | A1 | 11/2019 | LaGrange et al. | |
| 2019/0366272 | A1 | 12/2019 | Eitschberger et al. | |
| 2021/0254443 | A1 | 8/2021 | Qu | |
| 2022/0145732 | A1 | 5/2022 | Anthony et al. | |
| 2022/0307351 | A1* | 9/2022 | Oag | E21B 29/02 |

* cited by examiner

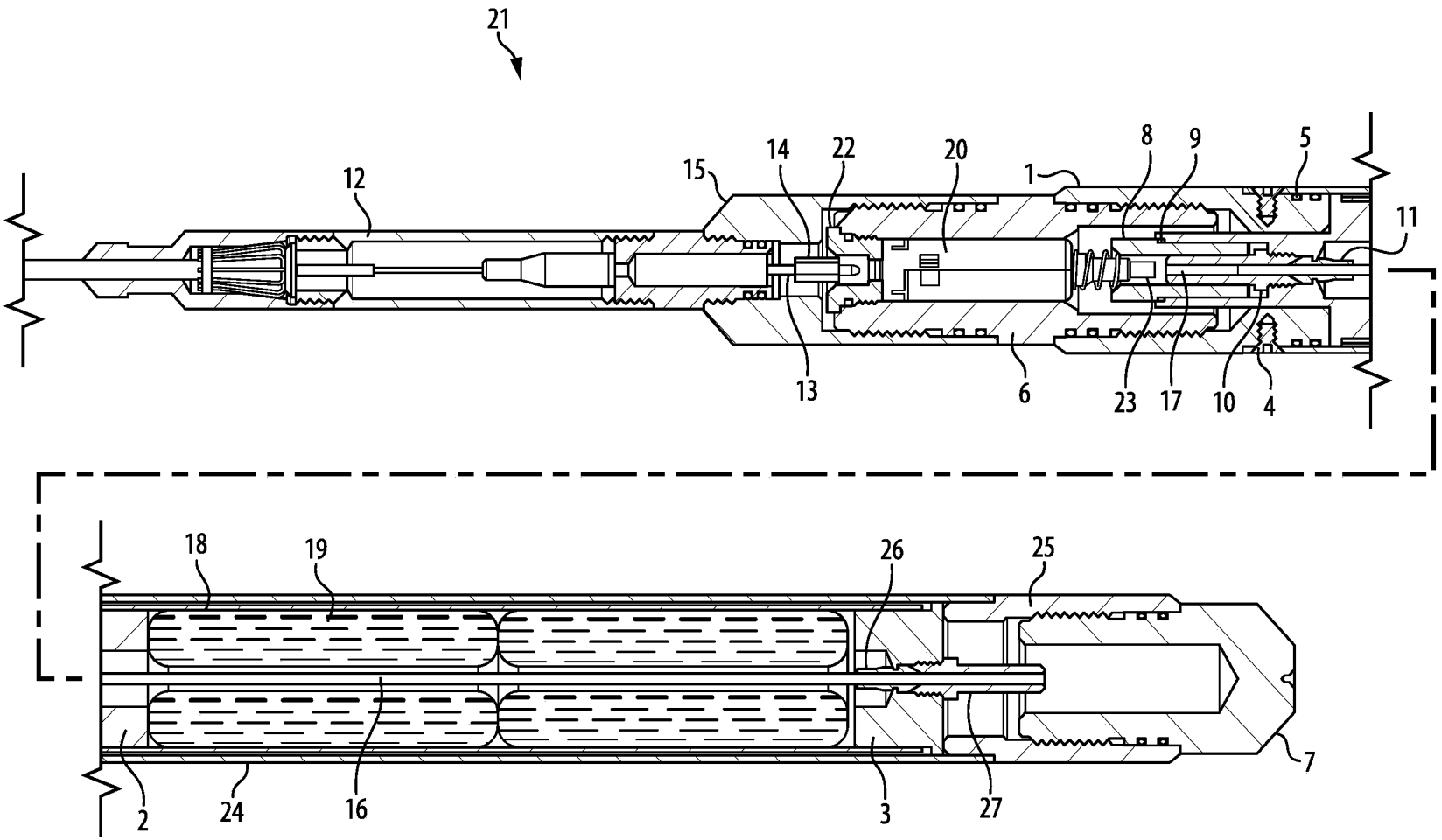
21
11
5
4
10
9
17
8
23
1
6
20
22
13
14
15
12
7
25
27
26
3
16
19
24
18
2

TOOL AND METHOD FOR SAFE CAVITY SHOT OPERATIONS

RELATED APPLICATIONS

This application claims priority to U.S. Provisional Application No. 63/368,205, filed Jul. 12, 2022.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically, a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

The objective for oil well plug and abandonment, or P&A, operations is to permanently seal the wellbore below ground level when it reaches the end of its useful life, such that hydrocarbons and other well fluids can no longer migrate to surface nor into downhole water tables. Example of P&A techniques include setting a plug, perforating the casing above the plug, washing out the annulus, then pumping cement on top of the plug and into the annulus creating a barrier across the wellbore. Such techniques are expensive and technically difficult to ensure a reliable anulus annulus cement plug. A second example P&A technique involves lowering a thermite tool into the well and melting an alloy to create a barrier across the wellbore at a specific depth. While effective, this technique is extremely expensive and, at many times, cost prohibitive. Another P&A technique, referred to as a "cavity shot", involves setting off explosive compounds above a casing plug to collapse the casing, wellbore and/or formation onto itself, creating a natural barrier. Cement is then pumped on top of the natural barrier to provide a permanent seal. Cavity shots are generally considered a cost-effective solution for P&A barriers; however, the current explosives used, such as nitroglycerine dynamite, are restricted to transport in many regions, are dangerous to handle and can be unintentionally initiated by extraneous energy sources at the wellsite. A safer, more widely accessible cavity shot system is needed for cost effective P&A operations.

SUMMARY OF EXAMPLE EMBODIMENTS

An example embodiment may include a downhole cavity shot tool comprising a housing, a reactive propellant material contained within the housing, an initiator assembly including firing head coupled to the housing which contains a high explosive initiator, wherein initiation of the high explosive initiator ignites the reactive propellant material, creating an explosive shockwave.

The downhole cavity shot tool of claim 1 wherein the detonation and resulting shockwave forms a cavity in the downhole well bore by collapsing one or more of the casings, wellbore and surrounding formation.

The propellant material may be a liquid. The liquid propellant may be housed in one or more flexible bags. The initiator assembly may include an addressable switch. The initiator may be immune to radio frequencies, stray voltages, and/or electrostatic discharge. The initiator does not require the field user to make any wire-to-wire or wire-to-contact connections during the arming process. The cavity tool does not require the field user to make any wire-to-wire or wire-to-contact connections during assembly.

An example embodiment may include a downhole cavity shot tool comprising a housing, a reactive propellant material contained within the housing, detonating cord disposed within the housing and surrounded by the reactive propellant material also contained in the housing, a firing head coupled to the housing which contains a high explosive detonator, wherein the detonator is ballistically coupled to the detonating cord when the firing head is installed onto the housing, wherein initiation of the high explosive detonator ignites the detonating cord, which then ignites the surrounding reactive propellant material, and wherein the resulting ignition of the reactive propellant material creates an explosive shockwave.

The detonation and resulting shockwave forms a cavity in the downhole well bore by collapsing one or more of the casings, wellbore and surrounding formation. The propellant material may be a liquid. The liquid propellant may be housed in one or more flexible bags. It may include an addressable switch. The detonator may provide immunity to radio frequencies, stray voltages, and/or electrostatic discharge. The detonator may not require the field user to make any wire-to-wire or wire-to-contact connections during the arming process. The cavity tool may not require the field user to make any wire-to-wire or wire-to-contact connections during assembly. The firing head may be a multiple piece or single piece firing head.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several FIGURES of the drawing. Briefly:

FIG. 1 shows an example embodiment of a side view cross-section of a downhole cavity shot tool.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

An example embodiment is shown in FIG. 1 of an assembly 21 comprising a cablehead assembly 12 coupled to a top adaptor 15. The top adaptor 15 is further coupled to a tandem body sub 6 having a threaded pin end, or male end, on either side. The tandem body sub 6 has a first inner bore at a first end containing a cartridge body 20 that includes a detonator 23 and an addressable switch within the cartridge body 20. The end cap 22 holds the cartridge body 20 in place and also provides an electrical feed thru to the addressable switch in the cartridge body 20. Contact plunger 13 electrically couples with the contact socket 14. The tandem body sub 6 contains a second bore at a second end that surrounds the top of the upper propellant end fitting 2. The upper housing sub 1 couples to the pin end of the tandem body sub 6. The cartridge body 20 provides that the user does not need to make any wire-to-wire or wire-to-contact connections during the arming process. Instead the cartridge body 20 relies on electrical contacts to make the electrical connection as a result of being installed in the tandem body sub 6.

The upper propellant end fitting 2 includes a booster insert 8 that has a hollow bore for locating the detonator 23 proximate to the booster 17. Booster 17 is held in place by the transfer fitting 10. A detonating cord 16 is located proximate to the booster 17 via grommet 11. O-ring 9 seals the booster insert 8 to the upper propellant end fitting 2.

Tool body 24 is coupled to the upper housing sub 1 via screws 4 and sealed with o-rings 5. Propellant bags 19 are located within the tool body 24 and surrounded with a wrap 18. Propellant bags 19 may be one or more flexible bags containing a liquid propellant. The wrap 18 may be composed of cardboard or similar type of material. Bottom propellant end fitting 3 along with upper propellant end fitting 2 hold the propellant bags 19 and wrap 18 in place. Lower housing sub 25 is coupled to the tool body 24. The detonating cord 16 is held in place by the grommet 26 and the transfer fitting 27. Bottom sub 7 is coupled to the bottom of the lower housing sub 25.

The example embodiment describes a cavity shot tool containing liquid propellant within propellant bags 19 initiated by an RF-Safe modular initiator, such as the assembly of the cartridge body 20 with a detonator 23 protruding and an addressable switch within the cartridge body 20. The main tool housing, tool body 24, is a hollow metal cylinder with a sealed bottom propellant end fitting 3. Detonating cord 16 is placed length wise down the middle of the tool body 24. Bags of liquid propellant 16 are dropped into the tool body 24 until the tool body 24 is full. A booster transfer firing head adapter, in this case upper housing sub 1, is connected to the top of the liquid propellant filled tool body 24 with the detonating cord 16 inserted into the transfer kit, which includes booster insert 8. An initiator firing head body, in this example tandem body sub 6, is installed onto the upper housing sub 1. The tandem body sub 6 is armed with a modular, RF-Safe, high explosive initiator which is immune to radio frequency, stray voltage, and electrostatic discharge typical to a wellsite environment. The entire assembly can then be connected to the cable head of the electric line and be lowered into the well bore.

The liquid propellant in propellant bags 16 is unique in that the homogeneous mixture has both the fuel and oxidizer making it safer and more easily transportable compared to traditional explosives used in cavity shot tools. The liquid propellant can also be initiated with either detonating cord or via electrical current.

A conventional plug, such as a cast iron bridge plug, is set at the desired depth in the casing of the wellbore set to be plugged and abandoned. On a subsequent run in well, the armed and loaded cavity shot tool can be conveyed into a well via electrical line. Once at the desired depth above the previously set plug, the operator can initiate the cavity shot using the surface control panel connected to the wireline by sending an electrical signal down the wireline to the RF-Safe modular initiator in the cavity shot tool. The high explosive initiator starts the ballistic train to the booster transfer and detonating cord which then initiates all the liquid propellant bags in the cavity shot carrier. The resulting downhole explosion can collapse the casing, wellbore and formation and forming a cavity in the wellbore. The remaining tool string is retrieved to surface. Then cement is pumped on top of the natural barrier to seal the wellbore.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in FIGURES as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a tool string such as described herein, the first, second, or third references, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A downhole cavity shot tool comprising:

a housing;

a reactive propellant material contained within the housing;

an initiator assembly including a firing head coupled to the housing, the firing head having a high explosive initiator therein;

an electrical contact configured to provide electrical pass through to an addressable switch within the initiator assembly when the firing head is installed in the housing, wherein initiation of the high explosive initiator via electrical current ignites the reactive propellant material, creating an explosive shockwave, wherein the reactive propellant material is a liquid propellant mixture of fuel and oxidizer.

2. The downhole cavity shot tool of claim 1 wherein the detonation and resulting shockwave forms a cavity in the downhole well bore by collapsing one or more of the casings, wellbore and surrounding formation.

3. The downhole cavity shot tool of claim 1, wherein the liquid propellant is housed in one or more flexible bags.

4. The downhole cavity shot tool of claim 1, wherein the initiator is immune to radio frequencies.

5. The downhole cavity shot tool of claim 1, wherein the initiator is immune to stray voltages.

6. The downhole cavity shot tool of claim 1, wherein the initiator is immune to electrostatic discharge.

7. A downhole cavity shot tool comprising:

a housing;

a reactive propellant material contained within the housing;

detonating cord disposed within the housing and surrounded by the reactive propellant material also contained in the housing;

a firing head coupled to the housing, the firing head having a high explosive detonator therein, wherein the detonator is coupled to the detonating cord when the firing head is installed onto the housing;

wherein initiation of the high explosive detonator via electrical current ignites the detonating cord, which then ignites the surrounding reactive propellant material;

wherein the resulting ignition of the reactive propellant material creates an explosive shockwave, wherein the propellant material is a liquid mixture of fuel and oxidizer.

8. The downhole cavity shot tool of claim 7, wherein the detonation and resulting shockwave forms a cavity in the downhole well bore by collapsing one or more of the casings, wellbore and surrounding formation.

9. The downhole cavity shot tool of claim 7, wherein the liquid propellant is housed in one or more flexible bags.

10. The downhole cavity shot tool of claim 7, further comprising an electrical contact configured to provide electrical pass through to an addressable switch within the initiator assembly when the firing head is installed in the housing.

11. The downhole cavity shot tool of claim 7, wherein the detonator provides immunity to radio frequencies.

12. The downhole cavity shot tool of claim 7, wherein the detonator provides immunity to stray voltages.

13. The downhole cavity shot tool of claim 7, wherein the detonator provides immunity to electrostatic discharge.

14. The downhole cavity shot tool of claim 7, wherein the firing head is a multiple piece firing head.

* * * * *